US007216447B2

(12) United States Patent
Bateman

(10) Patent No.: US 7,216,447 B2
(45) Date of Patent: May 15, 2007

(54) DISPLAY DEVICE

(75) Inventor: Roger Christopher Bateman, Bedford (GB)

(73) Assignee: Media Steps Group PLC, Bedford (GB)

( * ) Notice: Subject to any disclaimer, the term of this patent is extended or adjusted under 35 U.S.C. 154(b) by 52 days.

(21) Appl. No.: 10/476,731

(22) PCT Filed: May 20, 2002

(86) PCT No.: PCT/GB02/02367

§ 371 (c)(1),
(2), (4) Date: May 28, 2004

(87) PCT Pub. No.: WO02/095718

PCT Pub. Date: Nov. 28, 2002

(65) Prior Publication Data

US 2004/0216344 A1 Nov. 4, 2004

(30) Foreign Application Priority Data

May 21, 2001 (GB) ..... 0112325.6
Sep. 24, 2001 (GB) ..... 0122925.1

(51) Int. Cl.
*G09F 7/02* (2006.01)

(52) U.S. Cl. ..... 40/618; 40/649

(58) Field of Classification Search ..... 40/606.03, 40/606.09, 611.06, 649, 651, 611.04, 490, 40/618, 5, 655
See application file for complete search history.

(56) References Cited

U.S. PATENT DOCUMENTS

| | | | | | |
|---|---|---|---|---|---|
| 653,672 | A | * | 7/1900 | Goodwin | 40/651 |
| 1,430,980 | A | * | 10/1922 | Gideon | 40/611.05 |
| 1,787,308 | A | * | 12/1930 | Furlong | 40/649 |
| 1,856,012 | A | * | 4/1932 | Yeck | 40/618 |
| 4,729,183 | A | * | 3/1988 | Tarter et al. | 40/766 |
| 5,088,221 | A | | 2/1992 | Bussiere et al. | |
| 5,176,239 | A | | 1/1993 | Findlay | |
| 5,685,412 | A | | 11/1997 | Findlay | |
| 6,068,135 | A | | 5/2000 | Holztrager | |

FOREIGN PATENT DOCUMENTS

| | | | |
|---|---|---|---|
| DE | 4314772 | A1 | 11/1993 |
| JP | 10282920 | A | 10/1998 |

* cited by examiner

*Primary Examiner*—Cassandra Davis
(74) *Attorney, Agent, or Firm*—Grossman Tucker Perreault & Pfleger, PLLC

(57) ABSTRACT

A display device for displaying advertising material on a stair tread riser comprising a carrier adapted to be attached to a stair riser and an advertising plate adapted to be housed within the carrier.

4 Claims, 5 Drawing Sheets

DISPLAY DEVICE

FIELD OF THE INVENTION

The present invention relates to display devices. It is particularly applicable, but in no way limited, to display devices used to mount advertising material on the risers of stair treads.

BACKGROUND OF THE INVENTION

Advertising material can be displayed in a wide variety of locations at conference venues, exhibition halls, sporting events and the like. In modern venues more and more initiative is being shown in finding useful and creative ways for supporting advertising materials. One such surface is the outward face of risers on flights of stairs. The choice of this location is not new and it has been used in football grounds for example, for some time. However, this tends to be for permanent adverts such as the home club's logo or for sponsor's details. An entirely difference situation is found at conference venues when the advertising material must be changed prior to every event. Traditionally, such advertising is secured to the step riser by some form of adhesive, which enables the advert to be peeled off after the event, leaving no trace behind it. Typically this is achieved by using card, plastic or light metal boards with an adhesive backing.

Because stairways can be heavily trafficked and represent a potential health and safety hazard, special care must be taken to keep them safe and free from tripping hazards. If, during an event, a piece of advertising on a stair tread riser comes loose, the entire item must be removed immediately. If the item is part of a larger display then the whole display must be taken down. When one considers that many staircases are carpeted, including the risers, this presents a real challenge to the advert installer. A strong adhesive is required which will withstand scuffs and knocks from the footware of those using the staircase. However, the adhesive must leave no trace when the advertising strip is removed. Such requirements are mutually exclusive and thus stair risers are not used as an advertising medium as much as they might be.

In public areas, advertising material may be subjected to unwanted vandalism or theft. Accordingly, it is highly desirable to provide means for preventing the unauthorised removal of the advertising material, whilst still enabling authorised personnel to install or remove the advertising material quickly and easily.

It is the object of the present invention to overcome or mitigate some or all of the problems outlined above.

SUMMARY OF THE INVENTION

According to the present invention there is provide a display device for displaying advertising material on a stair tread riser comprising a carrier adapted to be attached to a stair riser and an advertising plate adapted to be housed within the carrier. By securing a carrier to the stair riser the difficulty of temporarily securing advertising in place is overcome.

Preferably the carrier comprises a carrier plate adapted to be fixed to the stair riser, said carrier plate incorporating retaining channels along the uppermost and lowermost longitudinal edges, said channels being adapted to accommodate and retain an advertising plate. The advertising plate can be slid into the retaining channels from one end or flexed to enable it to be placed into the channels from the front of the display device.

In a particularly preferred embodiment the carrier plate and retaining channels are of unitary construction. The carrier plate can thus be formed from a metal such as stainless steel by metal folding, aluminium or aluminium alloy by extrusion, or from plastic material.

Preferably the carrier plate is perforated with countersunk holes, said holes being adapted to accommodate conventional fixings such that the fixing heads do no protrude substantially proud of the plane of the carrier plate.

In a further embodiment the retaining channels are formed from rotatably mounted channel members, rotatably mounted with respect to the carrier plate, such that the channel member may be rotated away from the carrier plate to enable an advertising plate to be placed in to the carrier and then rotated back towards the carrier plate to retain the advertising plate in place. This alternative form of construction makes it easier to change the display material when sliding access from the side of the stair riser is not available.

Preferably the rotatably mounted channel members are resiliently bias towards a closed position in which they retain the advertising plate within the device.

Preferably the display device further comprises retaining means at an end of the device, said retaining means preventing the advertising plate from being slid longitudinally out of the display device. This advantageously prevents removal of the advertising plate by sideways sliding.

Particularly preferably the display device further comprises a lockable end cap to prevent unauthorised removal of the advertising plate from the display device. This advantageously prevents (or at least deters) the unauthorised removal of the advertising material, whilst enabling authorised personnel to install or remove the advertising material quickly and easily. It is possible to engineer the display device and the lockable end cap such that the carrier plate, once locked in place, is totally secure and cannot be removed by unauthorised personnel.

Particularly preferably the lockable end cap has a recess or cutaway region shaped to constrain an end of the advertising plate, and regions around the recess or cutaway region for attaching the end cap to the carrier.

Most preferably the regions of the lockable end cap around the recess or cutaway region are shaped and configured to constrain the advertising plate between the retaining channels and the end cap.

BRIEF DESCRIPTION OF THE DRAWINGS

The invention will now be described, by way of example only, with reference to the following drawings in which.

DESCRIPTION OF THE PREFERRED EMBODIMENTS

Embodiments of the present invention are described below by way of example only. These examples represent the best ways of putting the invention into practice that are currently known to the applicant, although they are not the only ways in which this could be achieved.

Figure 1:
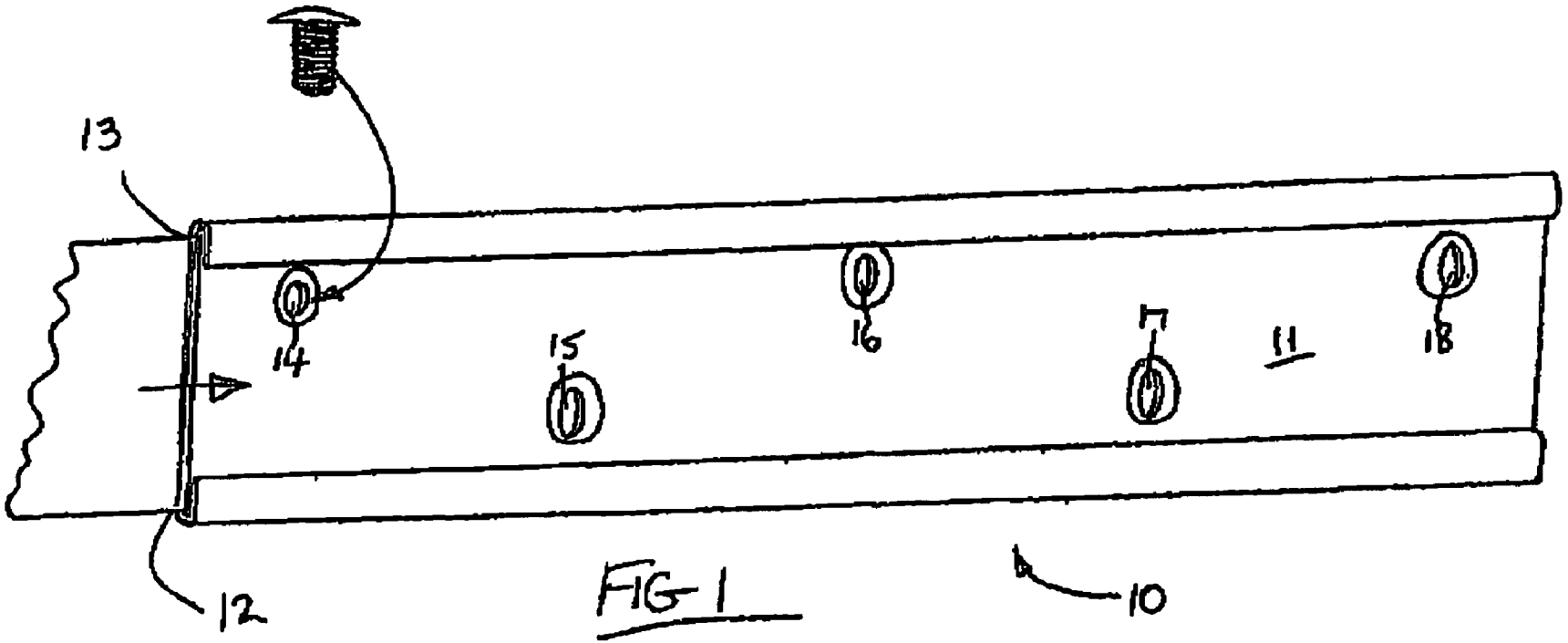
FIG. 1 illustrates a display device according to a first embodiment of the present invention.
Figure 2:
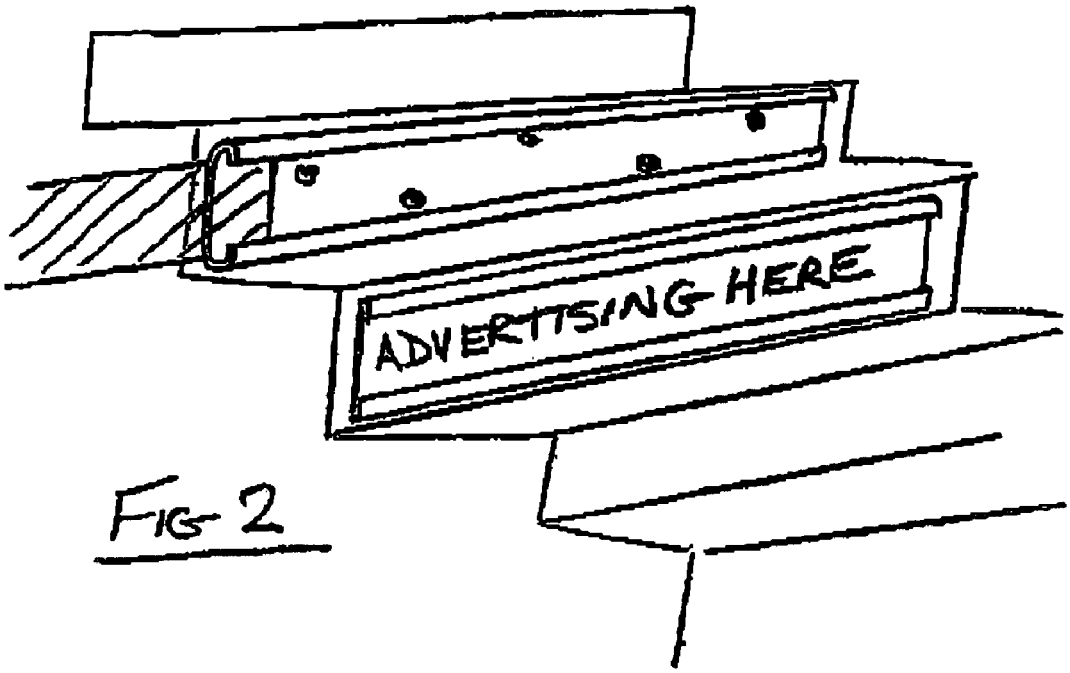
FIG. 2 illustrates a set of stairs with a display device as illustrated in FIG. 1 fixed to two of the risers.
Figure 3:
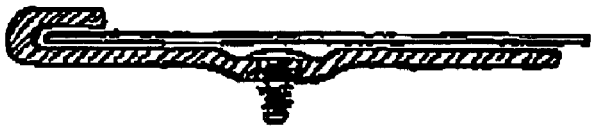
FIGS. 3 and 4 illustrate cross-sectional views through the display device of FIG. 1.
Figure 4:
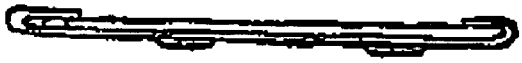
Figure 5:
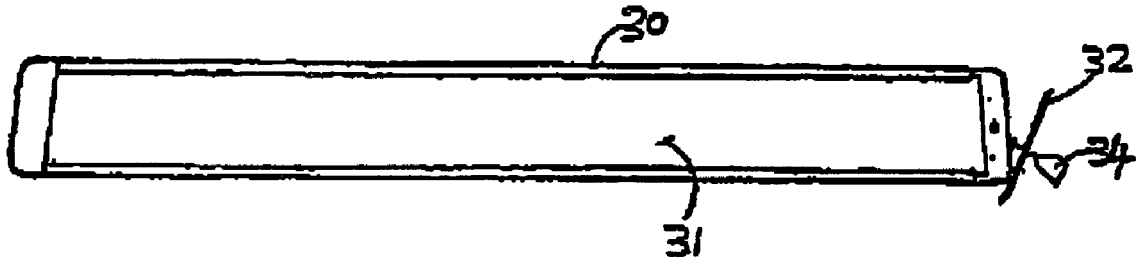
FIG. 5 shows a display device according to a second embodiment of the present invention, having a lockable end cap (shown removed and placed to one side)

FIG. 1 illustrates a display device 10 according to a first embodiment of the present invention. The device comprises a carrier plate 11 which has retaining channels 12, 13 along the opposing longitudinal edges i.e. at the top and the bottom of the stair riser when the display device is in use. The carrier plate is perforated with countersunk holes 14, 15, 16, 17 and 18. These holes are adapted to accommodate conventional fixings such as screws, bolts or, as in this case, plastic rivets. Because the head of the fixing is accommodated within the countersink then the fixing head does not extend substantially proud of the plane of the carrier plate. This makes it relatively easy to slide an advertising plate along the length of the display device without it snagging on the fixing heads.

In the present example the retaining channels are integral with the carrier plate. If a metal such as stainless steel is used then this arrangement can be created by known metal folding techniques starting from a piece of sheet metal. The retaining channels are thus formed by the back of the carrier plate and a returning rib, the inner surface of which is substantially parallel to the front of the carrier plate. The gap within the retaining channel is just wide enough to accommodate the decorated advertising plate.

In this example the display device is held in place onto the face of a stair riser using plastic rivets which engage with corresponding located holes in the stair riser. However, it is not essential to use plastic rivets and any other form of suitable fixing can be used. In the appropriate circumstances it would also be possible to secure the carrier plate to the front outward face of the step riser using a strong and permanent adhesive.

The advertising material to be displayed is printed onto a suitably sized sheet of material which is then slid from one side along the length of the carrier plate until the advertising plate and carrier plate coincide. In a preferred example, the substrate for the printed advertising material is enamelled steel since this provides a strong durable image. However, other materials could be used such as card, plastics materials or other metal surfaces. It will be appreciated that it is not necessary that the advertising plate 20 is slid in to the carrier plate because in certain instances there will not be sliding access from the side of the staircase. In this case it is necessary to bow or flex the advertising plate along is longitudinal axis in order that it can be snapped or slipped into the retaining channels from the front of the carrier plate. This is most easily done by slipping the lower edge of the advertising plate into the lowermost channel 12 and then flexing it such that the effective height is less than the distance between the opposing edges of the retaining channels 12 and 13 and then pressing the advertising plate home into the uppermost in use channel 13. This is easier to do if the advertising plate is of thin cross-section such as a 0.5 millimetre enamelled steel plate.

Optionally end caps (not shown) can be provided which clip in to the opposing ends of the carrier plate to prevent the advertising plate moving from side to side during use.

It will therefore he appreciated that the problem of how to retain an advertising plate on a stair riser has been solved by first fixing a carrier plate to the riser and fixing the advertising plate onto the carrier plate. It will also be appreciated that there are a number of other ways in which an advertising plate can be accommodated in or attached to a carrier plate. The carrier plate could, for example, be made from magnetic material or have an outer magnetic surface applied to it. An advertising plate of ferrous metal or of an opposite magnetic pole will then secure strongly to the carrier plate and retaining channels will not be required.

Alternatively, the retaining channels could be formed by hinged or pivotally mounted flaps which can be folded back out of the way to allow artwork to be inserted. Such folding mechanisms are known per se from the signage display industry but have not been employed in this context. Such flaps are generally spring-loaded such that they will stay open when folded back but are resilienty biased against the advertising plate when closed. This helps to retain the advertising material in place during use.

Any suitable material can be used to construct the present invention as recommended by the materials specialist. Metals such as steel or stainless steel can be used, with or without a powder coat or other finish. Other metals such as aluminium or aluminium alloys can be used, in which case the carrier plate can be formed by way of extrusion. A wide variety of plastics materials would also be suitable. Likewise, the advertising plate can be formed from any suitable material such as card, plastic sheet or other composite material or metals, including enamelled metals.

In order to prevent (or at least deter) the unwanted theft of the advertising material from the display device, a second embodiment of the invention, as shown in FIGS. 5, 6, 7, 8 and 9, incorporates a lockable end cap 32 at an end of the display device 30. In FIGS. 5, 6, 7 and 8, a blank advertising plate 31 is shown in place in the display device 30.

A hole 35 is provided in the display into which a locking member 33 may be inserted and locked by rotation. A key 34 is provided to enable the rotation of the locking member 33 by authorized personnel, facilitating (for authorized personnel) the ready removal and replacement of the end cap 32. The specific design and construction of locking mechanisms such as this are known to those skilled in the art.

Figure 6:
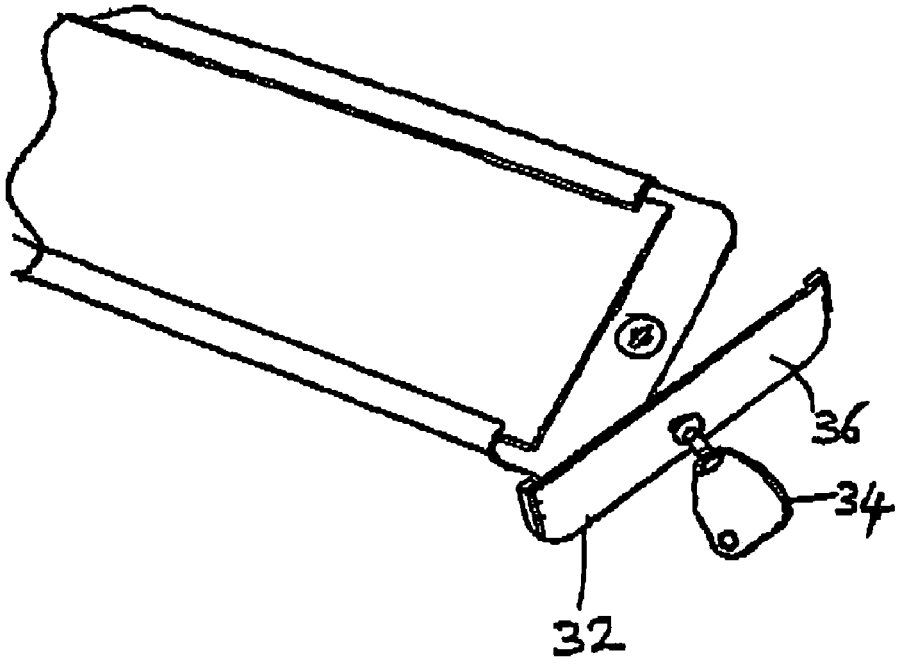
FIG. 6 is a close-up view of one end of the display device of FIG. 5.

As shown in FIG. 6, the outer surface 36 (in use) of the end cap 32 is substantially smooth and flat, giving a smart outward appearance to the display device.

Figure 7:
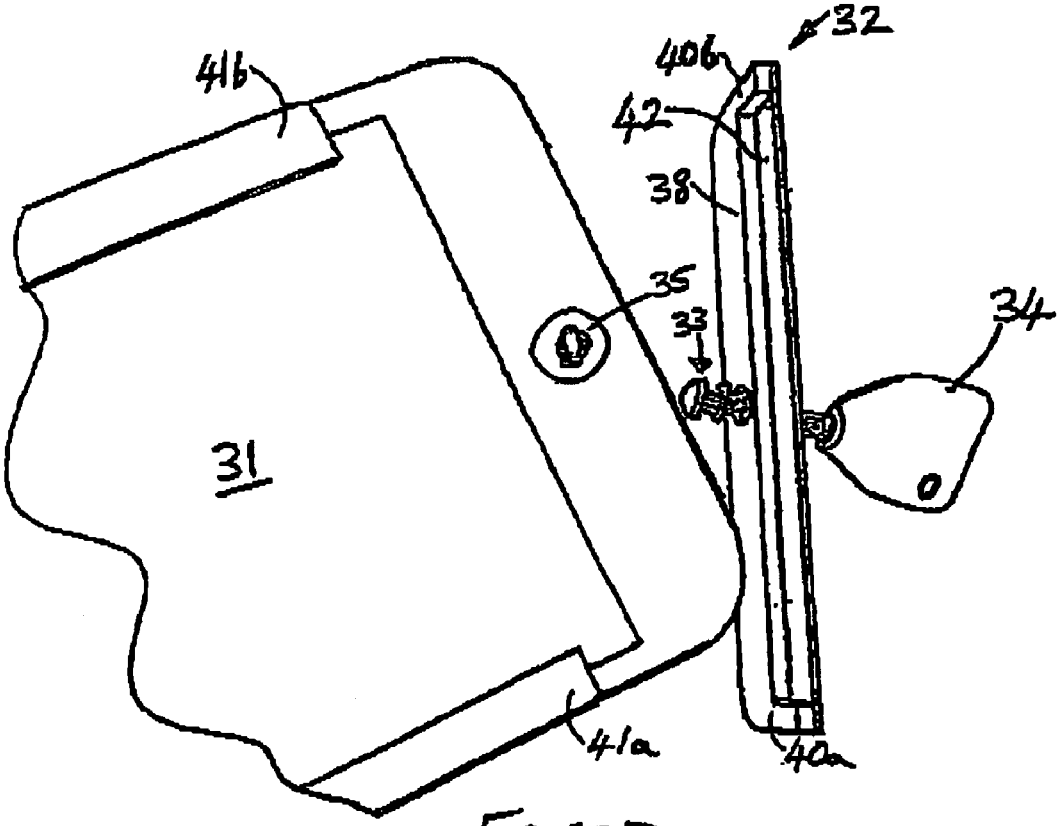
FIG. 7 is another close-up view of one end of the display device of FIG. 5.
Figure 8:
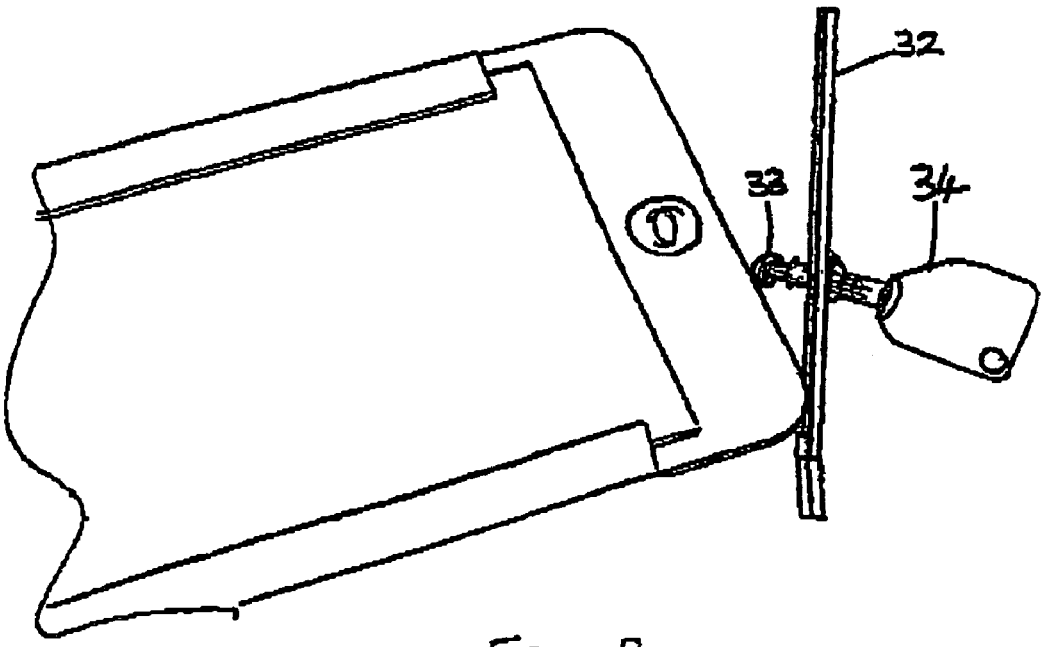
FIG. 8 is yet another close-up view of one end or the display device of FIG. 5.

With reference to FIG. 7, the underside 38 of the end cap 32 may be provided with a recess 42 shaped to accommodate the end of the advertising plate 31. On both sides of the recess 42 are edge portions 40*a* and 40*b* shaped such that, when the end cap 32 is locked onto the display panel 30, the edge portions 40*a* and 40*b* respectively abut the raised retaining channels 41*a* and 41*b* of the display panel 30.

Figure 9:
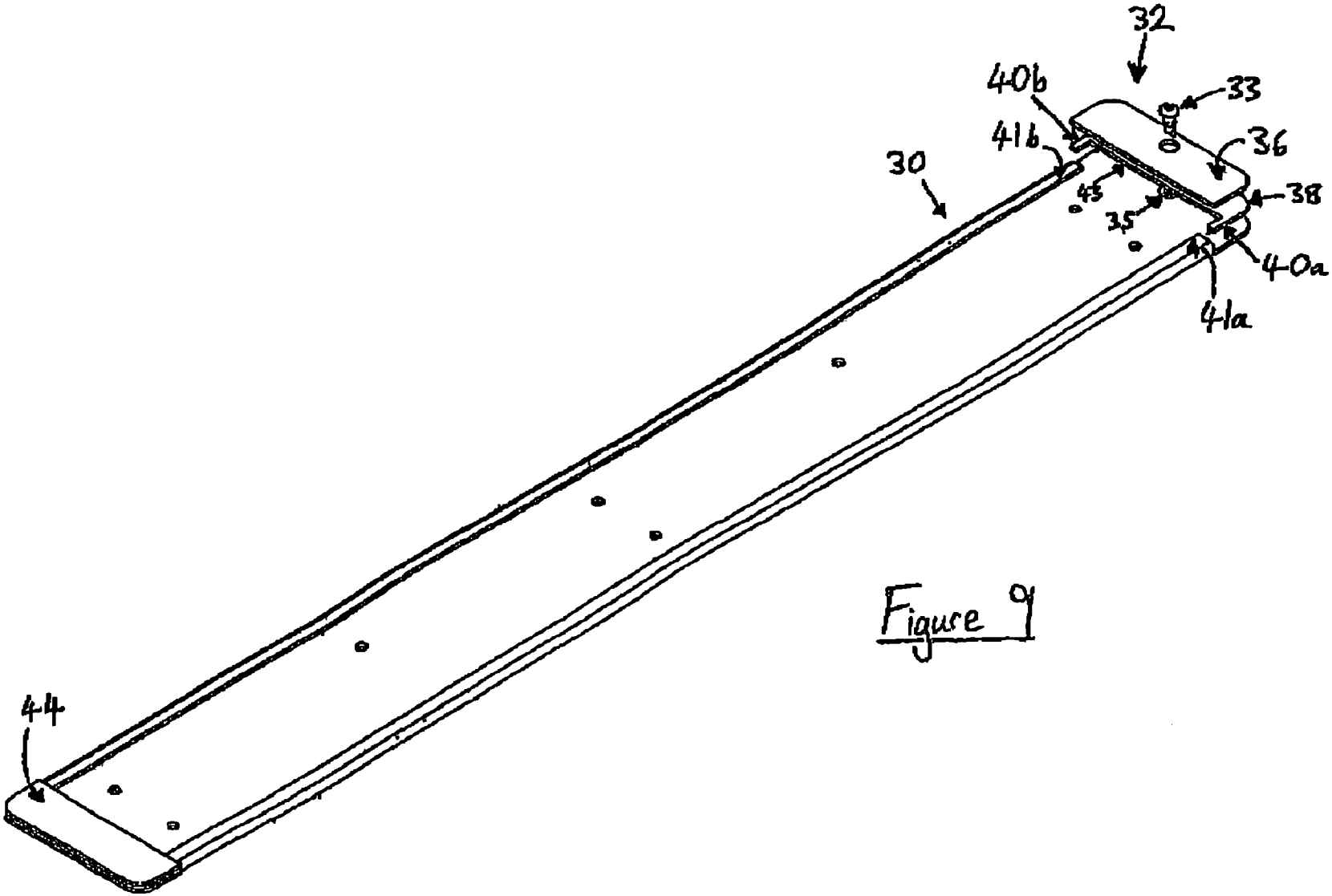
FIG. 9 illustrates another display device according to the second embodiment of the invention.

Alternatively, as shown in FIG. 9, the end cap 32 may be formed using two plates 36, 38. Here, the lower plate 38 incorporates a cutaway region 43 for accepting the advertising material, and includes the edge portions 40*a* and 40*b* for abutting the retaining channels 41*a* and 41*b* of the display panel 30. The upper plate 36 is smooth and flat as before, and, in use, partially overlaps the advertising material.

A permanent retaining member 44 is provided at the end of the display device distal from the lockable end cap 32. This prevents the advertising plate from being slid out of the display device in the direction away from the lockable end cap.

When the end cap 32 is locked in place, the advertising plate 31 is retained between the retaining channels 41*a* and 41*b*, the lockable end cap 32 and the permanent retaining member 44, and theft of the advertising material is thereby prevented or at least deterred.

To summarize, when the end cap 32 is locked in place, the advertising plate 31 is retained along both longitudinal edges and is also retained at both ends. This provides a high level of security to the advertising material. Indeed, the display device may be engineered such that the advertising plate 31, once locked in place, is totally secure and cannot be removed by unauthorized personnel.

In an alternative embodiment (not illustrated), a lockable end cap may be provided at both ends of the display device, to enable removal of the advertising plate in either direction by authorised personnel.

The invention claimed is:

1. A display device for displaying advertising material on a stair tread riser, the display device comprising a carrier plate having a first retaining channel and a second retaining channel along opposing longitudinal edges, said carrier plate is adapted to be attached to a stair riser, an advertising plate adapted to be disposed on the carrier plate and within said first retaining channel and said second retaining channel, and a lockable end cap configured to be locked on one side of said carrier plate, said lockable end cap having a recess on the underside thereof and two edge portions at opposite edges of said end cap and on both sides of said recess, wherein said recess is configured to accommodate an end of said advertising plate and wherein said edge portions are configured to abut said first retaining channel and said second retaining channel, respectively, in a non-overlapping manner and wherein said edge portions constrain said advertising plate between said channels, wherein when said lockable end cap is locked on said carrier plate.

2. A display device as claimed in claim 1, further comprising a permanent retaining member at another end of the device, said permanent retaining member preventing the advertising plate from being slid longitudinally out of said end of the display device.

3. A display device as claimed in claim 1, wherein the carrier plate is perforated with countersunk holes, said holes being adapted to accommodate one or more fixing elements to affix said carrier plate to said stair tread riser.

4. A display device as claimed in claim 1, wherein the carrier plate and retaining channels are of unitary construction.

* * * * *